US007624962B2

(12) United States Patent
Muyskens

(10) Patent No.: US 7,624,962 B2
(45) Date of Patent: Dec. 1, 2009

(54) PAPERBOARD BASE FOR AN APPLIANCE

(75) Inventor: David B Muyskens, Gallatin, TN (US)

(73) Assignee: Sonoco Development Inc., Hartsville, SC (US)

( * ) Notice: Subject to any disclaimer, the term of this patent is extended or adjusted under 35 U.S.C. 154(b) by 39 days.

(21) Appl. No.: 12/017,105

(22) Filed: Jan. 21, 2008

(65) Prior Publication Data

US 2008/0173781 A1 Jul. 24, 2008

Related U.S. Application Data

(60) Provisional application No. 60/885,933, filed on Jan. 22, 2007.

(51) Int. Cl.
*F16M 5/00* (2006.01)

(52) U.S. Cl. ..... 248/678; 248/346.01; 108/51.3

(58) Field of Classification Search ..... 248/346.01, 248/346.02, 346.3, 346.4, 678, 676; 108/51.3, 108/55.3
See application file for complete search history.

(56) References Cited

U.S. PATENT DOCUMENTS 2,475,079 A * 7/1949 Clouse et al. ..... 312/114
3,804,033 A * 4/1974 Izawa et al. ..... 108/53.5
4,130,199 A * 12/1978 Sorenson ..... 206/320
4,375,261 A * 3/1983 Kitchell ..... 206/320
4,399,972 A 8/1983 McCulloch
4,931,340 A 6/1990 Baba et al.
5,269,219 A 12/1993 Juvik-Woods
5,493,962 A 2/1996 McCarthy
5,537,937 A 7/1996 Juvik-Woods
5,647,284 A * 7/1997 Frysinger et al. ..... 108/55.1
5,865,315 A * 2/1999 Uitz ..... 206/600
6,155,527 A 12/2000 Muyskens
6,264,157 B1 7/2001 Muyskens
6,357,364 B1 3/2002 Maloney et al.
6,409,076 B1 * 6/2002 Wang ..... 229/122.34
D477,703 S * 7/2003 Chen ..... D34/38
6,725,783 B2 * 4/2004 Sekino ..... 108/55.3
7,347,328 B2 * 3/2008 Hartwall ..... 206/600
2003/0000432 A1 * 1/2003 Crevillen ..... 108/51.3

* cited by examiner

*Primary Examiner*—Korie Chan
(74) *Attorney, Agent, or Firm*—Clausen Miller PC

(57) ABSTRACT

A paper base for supporting an object such as a large household appliance is provided. The base comprises a honeycomb middle layer sandwiched between and substantially coextensive with top and bottom trays made from corrugated board. A platform can be mounted above the top tray to support a washing machine motor or other object.

13 Claims, 2 Drawing Sheets

PAPERBOARD BASE FOR AN APPLIANCE

BACKGROUND

1. Field of the Invention

This patent relates to packaging. More particularly, this patent relates to a paperboard base for cushioning and protecting a large appliance during shipping and handling.

2. Description of the Related Art

Base pads, sometimes referred to as carriers, skids, runners, pallets, or simply bases, are used to cushion and protect objects such as large appliances during assembly, storage and transport. Numerous appliance bases are known in the art, including bases made of wood, plastic, corrugated paper, and composite bases made of a combination of materials. Sonoco Development, Inc., the owner of the present invention, owns a number of patents in this field, including U.S. Pat. Nos. 6,155,527 and 6,264,157.

Appliance manufacturers are continually seeking better, more cost effective bases to provide cushioning and protection for large household appliances. A number of patents disclose bases having a honeycomb structural component, including U.S. Pat. Nos. 4,399,972; 5,269,219; 5,493,962; 5,537,937 and 6,357,364. The applicant has found that a combination of a honeycomb layer disposed between corrugated trays provides better strength and cushioning than either honeycomb or corrugated board alone.

Thus it is an object of the present invention to provide an appliance base that provides cushioning and protection of large appliances and can be made entirely from paper.

A further object of the invention is to provide an appliance base that is lightweight, yet passes standard drop tests and resists breakage.

Another object of the invention is to provide a base that can flex and give during impact to cushion and protect the unit during shipping.

Another object of the invention is to provide a base that can support a washing machine motor from below to prevent the motor from free movement during shipping.

Further and additional objects will appear from the description, accompanying drawings, and appended claims.

SUMMARY OF THE INVENTION

The present invention is an all-paper base for supporting an object such as a large household appliance. The base comprises a bottom tray made from a sheet of corrugated board, a top tray made from a sheet of corrugated board and having flaps located at its corners that can be folded down to create corner post clearances, and a middle layer of honeycomb material interposed between and substantially coextensive with the bottom and top trays. The middle layer also has corner post clearances at its corners that are vertically aligned with the top tray corner post clearances in the assembled base. The bottom tray extends below the vertically aligned clearances so that the corner posts can rest on and be supported by the bottom tray. Four sets of vertically aligned openings near the corners of the top tray and the middle layer can accommodate the appliance legs.

The improved base can include a platform mounted partially within central openings in the top tray and middle layer and extending above the top tray to support a part of the appliance, such as the appliance motor. The platform comprises a honeycomb filler at least partially encapsulated by a small boxlike structure formed from folded paperboard.

THE DRAWINGS

DETAILED DESCRIPTION OF THE INVENTION

Figure 1:
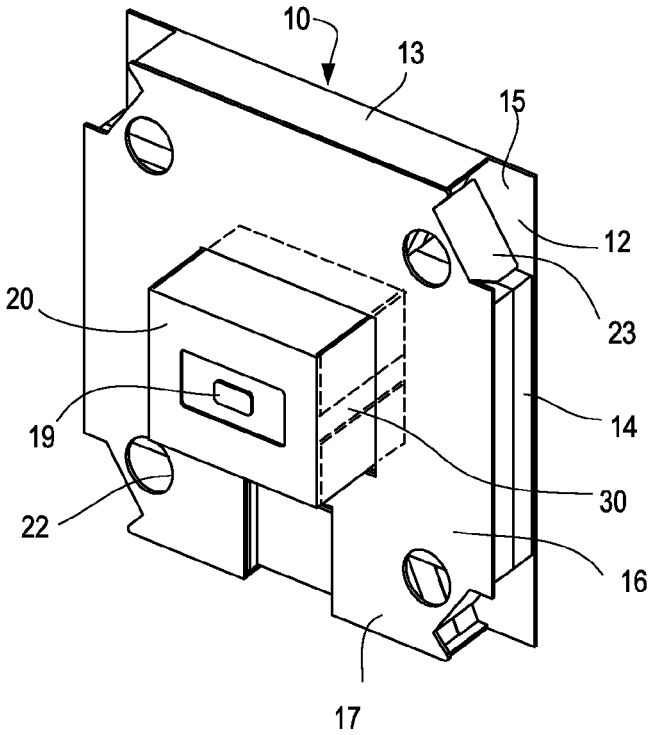
FIG. 1 is a perspective view of a paperboard base made according to the present invention.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Turning to the drawings, there is shown in FIG. 1 a perspective view of one embodiment of the present invention, a base 10 for supporting an object such as a large household appliance. The base 10 can be made entirely from paperboard, although other materials may be used, such as plastic.

The base 10 comprises a honeycomb middle layer 14 sandwiched between and substantially coextensive with top and bottom trays 16, 12, and a raised platform 30. The platform 30 comprises a block of honeycomb filler 18 at least partially encapsulated by a boxlike structure 20. The platform 30 is designed to support a motor or other object, as described in more detail below. The top and bottom trays 16, 12 preferably are each made from corrugated board, that is, board having a central fluted layer to which flat sheets have been glued to either side. The middle layer 14 and filler 18 are made from honeycomb, that is, a cellular structural material, or any other suitable material. The boxlike structure 20 is made from folded paperboard.

Figure 2:
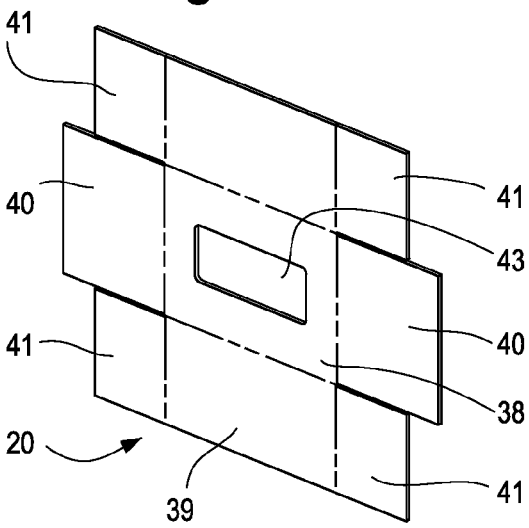
FIG. 2 is a top perspective view of a blank used to make part of the paperboard base of FIG. 1.

FIG. 2 shows a blank used to make the boxlike structure 20. The blank comprises a rectangular top panel 38, two side panels 39 and two end panels 40 hingedly connected to the four edges of the top panel 38 along fold lines. Glue tabs 41 are hingedly connected to opposing edges of the side panels 39. An aperture 43 may be cut into the top panel 38 to accommodate a rod or other component that extends below the motor or other object being supported by the platform 30.

Figure 3:
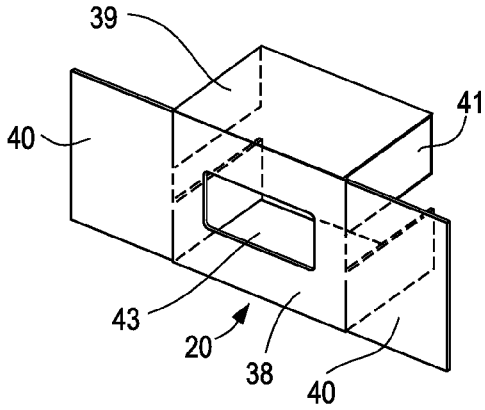
FIG. 3 is a top perspective view of the blank of FIG. 2 shown partially folded.

FIG. 3 shows the boxlike structure 20 in a partially assembled state. The side panels 39 have been downwardly folded at a ninety degree angle and the glue tabs 41 have been folded inwardly at a ninety degree angle to the side panels 39. The end panels 40 can now be folded downward and glued to the glue tabs 41 to complete the assembly of the boxlike structure 20.

Figure 4:
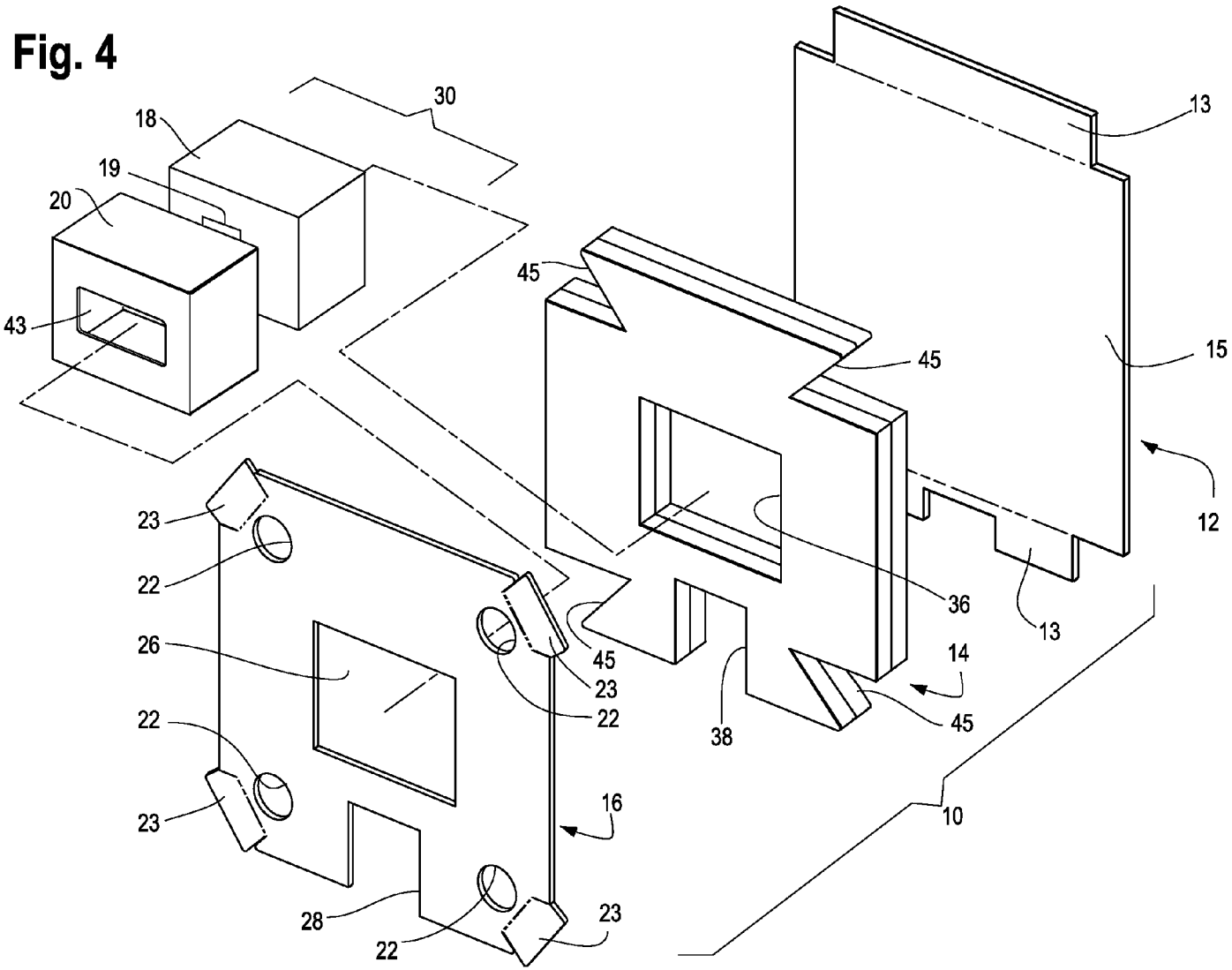
FIG. 4 is an exploded view of the paperboard base of FIG. 1.

The filler 18, shown in FIGS. 1 and 4, is block shaped, that is, shaped like a six sided rectilinear object, and is partially encapsulated by the boxlike structure 20 in the assembled base 10. The filler 18 may have a hollowed out area 19 communicating with the top surface of the filler 18 to further accommodate a rod or other component extending below the motor being supported by the platform 30.

The platform 30 nests within the central openings of the top tray 16 and middle layer 14 as described more fully below, and is designed to support a downwardly extending appliance motor (not shown) and keep the motor from free movement during shipping. The aperture 43 formed in the top panel 38 of the boxlike structure 20 and the hollow area within the filler 18 can accommodate a rod or other item extending downward from the washing machine motor. The platform 30 should have appropriate dimensions and be raised above the top tray 16 a predetermined height to adequately support the motor.

The central openings in the top tray 16 and middle layer 14 need not be exactly centrally located. Rather, they should be positioned so that the platform 30 can support a downwardly extending portion of the appliance.

Referring now to FIG. 4, the top tray 16 is made from a flat sheet of corrugated board that has been cut and folded into a desired configuration. More specifically, the top tray 16 comprises a substantially rectangular top panel 17 having four corners. The top panel 17 helps support the bottom of the appliance at areas other than just the feet. Feet openings 22 near the top panel corners can accommodate appliance feet (not shown). A central opening 26 located in the top panel 17 distant (away) from the corners accommodates the platform 30.

Optionally, one or more side openings 28 may be cut into the top panel to accommodate other items protruding downwardly from the bottom of the appliance. The top tray 16 also comprises flaps 23 hingedly attached to the corrugated sheet 17 at the corners so that folding the flaps 23 down creates corner post clearances (i.e., open spaces or notches) to accommodate vertical corner posts (not shown).

The middle layer 14 comprises a substantially rectangular layer of honeycomb material thicker than the top and bottom trays, or, as shown in the figures, two or more vertically stacked layers. The middle layer 14 has cut out areas substantially vertically aligned with the cut out areas of the top tray 16. Thus, as shown in FIGS. 1 and 2, the middle layer 14 has feet openings 45 cut into the middle layer 14 at the corners to accommodate appliance feet and to provide clearances to accommodate vertical corner posts. The middle layer 14 may also have a central opening 36 located distant from the corners and into which may be fitted the platform 30 and, optionally, one or more side openings 38 to accommodate other items protruding downwardly from the bottom of the appliance.

In addition to accommodating various protruding items of the unit such as feet, a motor and electrical plugs, the cut out areas in the top tray 16 and middle layer 14 help retain the items in a cushioned area within the base 10 to keep them from being damaged during impact.

Although the middle layer 14 is shown in the figures as being made of two sheets of honeycomb material in vertical alignment, each having a thickness of approximately ¾ inches, it should be understood that the middle layer can comprise any suitable number of sheets of honeycomb material in vertical alignment, including just a single sheet of suitable thickness, typically about 1½ inches. Further, it should be understood that the middle layer 14 can comprise multiple pieces of honeycomb material arranged in a horizontal plane between the top and bottom trays 16, 12, as long as the honeycomb material extends beneath the load supporting areas of the top tray 16. Preferably the middle layer 14 is thicker than either the bottom tray 12 or the top tray 16.

The bottom tray 12 is made from a flat rectangular sheet of corrugated board. Preferably the bottom tray includes one or more side panels 13 hingedly attached to a bottom panel 15 and extending upwardly therefrom to further encapsulate the honeycomb middle layer 14. The bottom tray 12 extends below the vertically aligned corner post clearances in the top tray 16 and middle layer 14 (described above) to support the corner posts.

The base 10 may be assembled as follows. The top tray 16 and middle layer 14 are placed onto a bottom tray 12 such that the three components align vertically as shown in FIG. 1. Glue or other adhesive may be sued to secure the three components together. The top tray flaps 23 are folded down to create the corner post clearances, and the bottom tray side panels 13 are folded upward against the middle layer 14.

The boxlike structure 20 is placed over the honeycomb filler 18 to partially encapsulate it, and may be secured to the filler 18 with adhesive to form the platform 30. The platform 30 is inserted into the vertically aligned central openings 26, 36 in the top tray 16 and the middle honeycomb layer 14 to nest therein and rests on the bottom tray 12.

Thus there has been described a base 10 for a unit such as a washing machine or other appliance that supports the unit and keeps its various parts from being damaged. The base 10 may be made from paperboard so that it can flex and give during impacts while still cushioning and protecting the unit during shipping. The base 10 helps support the appliance motor and restrain it from movement, and has cut out areas to accommodate items protruding from the bottom of the unit. Finally, the base 10 is designed to spread the load of the unit over a larger area, which otherwise would be concentrated at the feet, by supporting the bottom of the appliance at areas other than just the feet.

When used in conjunction with paperboard corner posts and a paperboard top cap, the base helps provide an all paper package that can withstand ordinary impact forces and significantly reduce package waste, particularly waste from EPS packaging.

It is to be understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

I claim as my invention:

1. An improved base for supporting for an appliance, the base comprising:

a substantially planar top tray having corners and a first central opening located distant from the corners;

a substantially planar bottom tray spaced from and substantially parallel to the top tray;

a middle layer having a thickness exceeding that of the top or bottom trays, the middle layer interposed between the top and bottom trays, the middle layer having corners and a second central opening located distant from the corners and vertically aligned with the first central opening; and a platform nested within the first and second central openings and extending above the top tray to support a part of the appliance.

2. The improved base of claim 1 wherein the top tray and middle layer have vertically aligned clearances at their respective corners; and wherein the bottom tray extends below the vertically aligned clearances.

3. The improved base of claim 2 wherein the clearances are configured to accommodate vertical corner posts.

4. The improved base of claim 1 wherein the platform comprises a filler partially encapsulated by a boxlike structure formed from folded material.

5. The improved base of claim 1 further comprising four sets of vertically aligned openings near the corners of the top tray and the middle layer to accommodate appliance legs.

6. The improved base of claim 1 wherein the top tray, bottom tray and middle layer are made from paper.

7. The improved base of claim 6 wherein the top tray and bottom tray are made from corrugated board and the middle layer is made from honeycomb.

8. The improved base of claim 2 wherein the top tray further comprises a top panel in which the first central opening is located and flaps hingedly attached to the top panel near the corners so that folding the flaps down creates the top tray clearance.

9. An improved base for supporting for an appliance, the base comprising:

a substantially planar top tray comprising a top panel, the top panel having corners and a first central opening located distant from the corners, the top tray further comprising flaps hingedly attached to the top panel at the corners so that folding the flaps down creates clearances;

a substantially planar bottom tray spaced from and substantially parallel to the top tray;

a middle layer having a thickness exceeding that of the top or bottom trays, the middle layer interposed between and substantially coextensive with the top and bottom trays, the middle layer having corners, clearances at the corners, and a second central opening located distant from the corners and vertically aligned with the first central opening; and a platform nested within the first and second central openings and extending above the top tray to support a part of the appliance, the platform comprising a filler partially encapsulated by a boxlike structure formed from folded material;

wherein the top tray and middle layer clearances are vertically aligned; and wherein the vertically aligned clearances are configured to accommodate vertical corner posts; and wherein the bottom tray extends below the vertically aligned clearances to support the vertical corner posts.

10. The improved base of claim 9 wherein the top tray, bottom tray, middle layer and platform are all made of paper.

11. The improved base of claim 10 wherein the top tray, bottom tray and boxlike structure are made from corrugated board; and the middle layer and filler are made from honeycomb.

12. An improved base for supporting for a product, the base comprising:

a middle layer interposed between a top tray and a bottom tray, the top and bottom tray having corners, the middle layer and top tray defining clearances located above the bottom tray corners for accommodating vertical corner posts that rest on the bottom tray; and a platform adjacent to and extending above the top tray to support a part of the product, the platform located distant from the corners of the top tray, the platform defining an aperture formed therein for receiving a downwardly extending item.

13. The improved base of claim 12 further comprising four sets of vertically aligned openings near the corners of the top tray and the middle layer to accommodate appliance legs.

* * * * *